US006971641B1

(12) United States Patent
Sherwin

(10) Patent No.: US 6,971,641 B1
(45) Date of Patent: Dec. 6, 2005

(54) AUTOMATICALLY CLOSING ADJUSTABLE CLAMP

(75) Inventor: Stanley Mitchell Sherwin, Albany, CA (US)

(73) Assignee: Stanley M. Sherwin, Albany, CA (US)

( * ) Notice: Subject to any disclaimer, the term of this patent is extended or adjusted under 35 U.S.C. 154(b) by 133 days.

(21) Appl. No.: 10/689,794

(22) Filed: Oct. 20, 2003

(51) Int. Cl.[7] ..... B25B 1/20

(52) U.S. Cl. ..... 269/166; 269/221

(58) Field of Search ..... 269/166–171.5, 269/147–149, 221

(56) References Cited

U.S. PATENT DOCUMENTS

| | | | |
|---|---|---|---|
| 2,815,778 | A | 2/1957 | Holman |
| 4,088,313 | A | 5/1978 | Pearson |
| 4,563,921 | A | 1/1986 | Wallace |
| 4,926,722 | A | 5/1990 | Sorensen et al. |

*Primary Examiner*—Robert C. Watson

(57) ABSTRACT

A clamp which can be closed with one hand consists of two telescoping sleeves, one inside the other, with a fixed jaw at one end of the inner sleeve and a movable jaw that is caused to travel back and forth along the length of the inner sleeve by means of a connecting band. This band is routed around two rotating spindles within the body of the clamp in such a way that when the fixed jaw is placed against the work and the outer sleeve is drawn back, the movable jaw moves forward until it contacts the other side of the work. The clamp is then tightened by means of a handle mounted on a threaded shaft.

20 Claims, 6 Drawing Sheets

4A
4B
10
12
16
18
30
32
34
38

AUTOMATICALLY CLOSING ADJUSTABLE CLAMP

CROSS REFERENCE TO RELATED APPLICATIONS

Not Applicable

SEQUENCE LISTING OR PROGRAM

Not Applicable

BACKGROUND

1. Field of Invention

This invention relates to bar clamps used in manufacturing, specifically for such clamps used to temporarily hold together two or more pieces for gluing, machining, aligning, or other processes.

2. Prior Art

The concept of a bar clamp with one active, movable jaw and one inactive, fixed jaw is very well known. U.S. Pat. No. 2,815,778 to Holman (1957) shows the basic design. While ubiquitous and indispensable, these clamps are difficult to use in less than optimal conditions because two hands are required to operate the clamp itself, leaving no hands available to hold or align the work. In woodworking, for example, when gluing parts together for a final assembly, several things are happening at once; the glue is beginning to dry, the parts have to be maintained in precise alignment while the clamps are attached, and freshly machined, cut, or finished surfaces have to be protected from glue drips, dents, and damage from the clamps themselves. Although time is of the essence and the work must be held correctly, both hands are required to operate the clamp. A third hand would often be useful.

U.S. Pat. No. 4,926,722 to Sorensen et al, (1990) shows one attempt to address this problem. In this design, a fixed jaw it attached to one end of a rigid bar, and a movable jaw is made to travel forward along the bar by repeatedly squeezing and releasing a spring loaded handle attached to the movable jaw. A series of locking cams are engaged and disengaged in sequence, which causes the jaw to move incrementally along the bar until it contacts the work being clamped. However, there are several drawbacks with Sorensen's design. First, while it is possible to hold the bar and move the active jaw with one hand, the movement along the bar is in very small increments. To move the jaw a longer distance along the bar requires the use of a second hand, thereby eliminating the design's main advantage. Also, the grip-and-squeeze motion which moves the jaw along the bar is inefficient and soon becomes tiring. Another major drawback is that the amount of clamping pressure available to the user is limited by the mechanism which causes the jaw to move. Once the movable jaw finally arrives at the work piece, the operator can do no more than keep squeezing the grip to apply the clamp's maximum pressure. This mechanism functions primarily as a means of moving the jaw along the bar and is often not capable of applying sufficient pressure to the work. Another drawback is that it requires a separate mechanism to release the pressure; this mechanism does not allow a reverse one-handed movement of the active jaw along the bar. Finally, it is very complex, requiring any number of keys, cams, springs, etc., all of which are subject to wear.

U.S. Pat. No. 4,088,313 to Pearson (1978) and U.S. Pat. No. 4,563,921 to Wallace (1986) also both propose one-handed operation, but these are pliers-type designs. They are difficult to adjust for larger objects and therefore of limited use.

BACKGROUND—OBJECT AND ADVANTAGES

Accordingly, several objects and advantages of the present invention are:

(a) to provide an improved clamp, (b) to provide a clamp with an active jaw which can be moved smoothly and rapidly any distance along the length of the bar using one hand only, (c) to provide a clamp in which the final tightening process is not limited by the mechanism which moves the jaw along the bar, and, (d) to provide a self-closing clamp which does not require a separate mechanism in order to release the clamping pressure.

Additional objects and advantages are to provide a self-closing clamp which is useful in a variety of manufacturing situations, which can be used to secure work pieces to each other or to an assembly bench quickly and easily, which is is useful in complex situations where hands are needed for precise alignment of parts or other functions, and which can be installed and removed with one simple motion. Further objects and advantages will become apparent from a consideration of the ensuing description and drawings.

SUMMARY

In accordance with the present invention an automatically closing clamp comprises an elongated body made up of two telescoping sleeves one inside the other, with a fixed jaw attached to one end of the inner sleeve. A movable jaw is made to travel back and forth along the inner sleeve by means of a flexible band routed around a spindle at each end of the inner sleeve. The two ends of this flexible band are attached to opposite ends of the outer sleeve in such a way that when the outer sleeve is drawn back, the movable jaw moves forward against the fixed jaw and can then be tightened by means of a handle on a threaded shaft.

DRAWINGS—FIGURES

DRAWINGS—REFERENCE NUMERALS

Figure 1A:
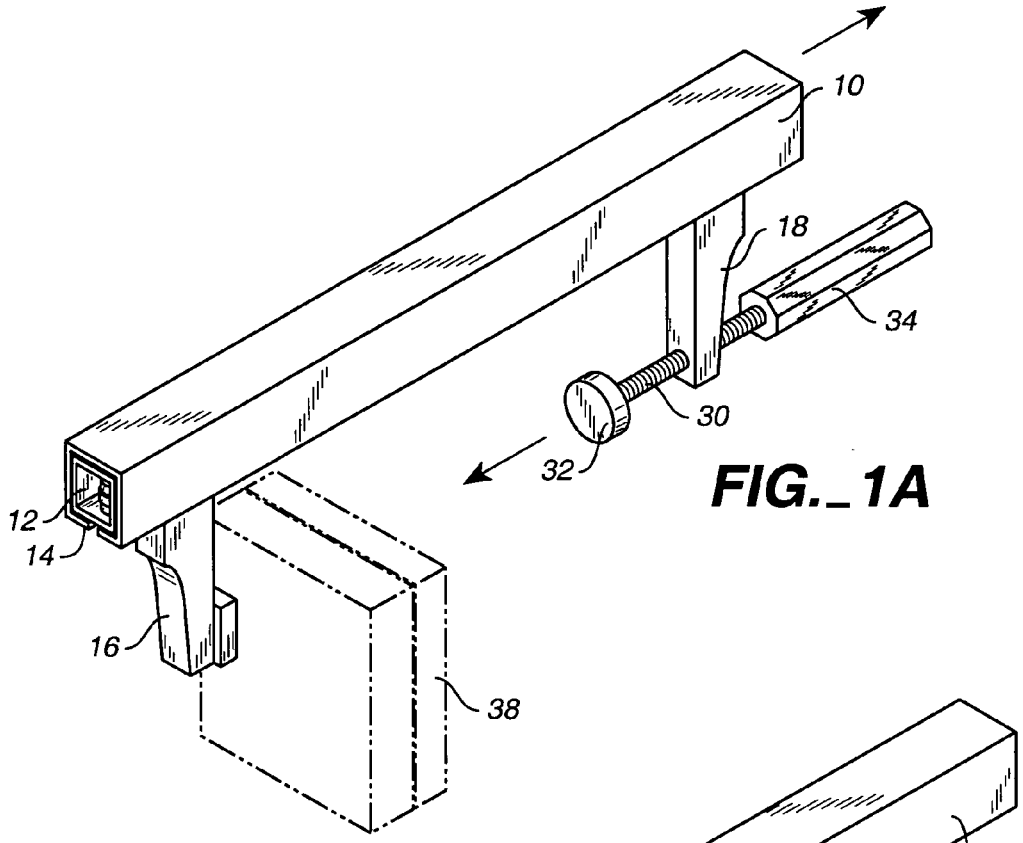
FIGS. 1A and 1B show a perspective view of an exterior body of a clamp in accordance with the invention.
Figure 1B:
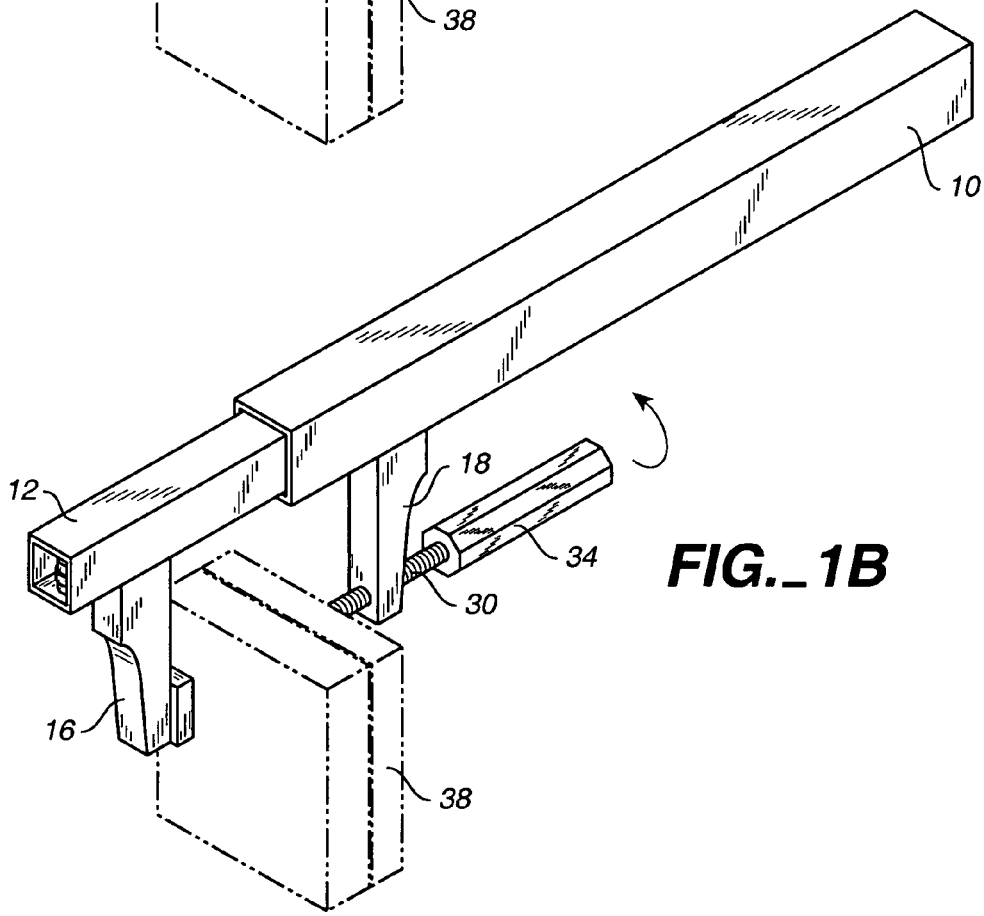

| | |
|---|---|
| 10 outer sleeve | 11 vertical face |
| 12 inner sleeve | 14 slot |
| 16 fixed jaw | 18 movable jaw |
| 20 front rotating spindle | 22 rear rotating spindle |
| 24 operating band | 26 front fixed point |
| 28 rear fixed point | 29 groove |
| 30 threaded shaft | 32 pad |
| 34 handle | 36 hardened plate |
| 38 work piece | |

DETAILED DESCRIPTION—FIGS. 1–6—PREFERRED EMBODIMENT

A preferred embodiment of a self-closing clamp according to the present invention is illustrated in FIGS. 1–6. The body of the clamp comprises an outer sleeve or tube 10 and an inner sleeve or tube 12 (FIGS. 1A, B). These sleeves are of identical length, with inner sleeve 12 being sized so that it will slide freely within outer sleeve 10. Each sleeve has a rectangular cross-section. A longitudinal slot 14 (FIGS. 5, 6) is cut into the bottom face of outer sleeve 10 and a longitudinal slot 14 is cut into the bottom face of inner sleeve 12. When inner sleeve 12 is fully enclosed within outer sleeve 10, this slot provides access to the interior of inner sleeve 12. Inner sleeve 12 has a short vertical face 11 on each side of the slot.

Figure 2A:
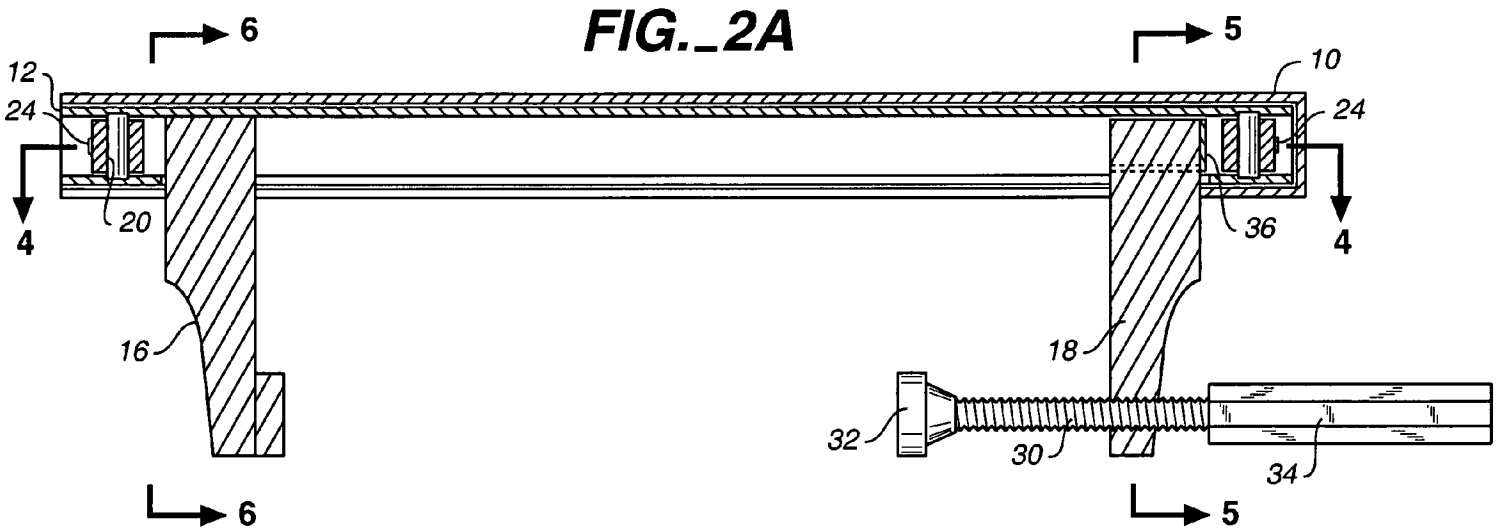
FIG. 2A shows a vertical section taken lengthwise through the center of the clamp, with its two jaws separated.

Enclosed within inner sleeve 12 are two jaws of the clamp (FIG. 2A). A fixed jaw 16 is attached to the front end (left end in FIG. 2A) of the inner sleeve, and a movable jaw 18 is free to slide back and forth along the length of the inner sleeve. Jaws 16 and 18 (FIG. 5) each have an upper portion and a lower portion, and are shaped so that the upper portion is contained within inner sleeve 12 and the lower portion extends down through slot 14.

Figure 7A:
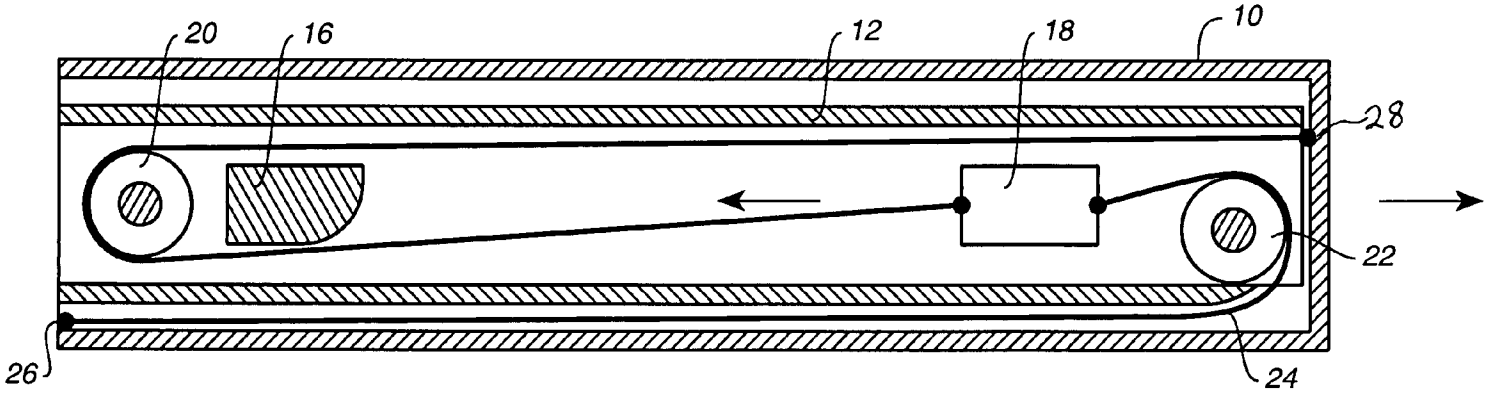
FIGS. 7A and 7B show the routing of an operating band with movable jaw in open and closed position.
Figure 7B:
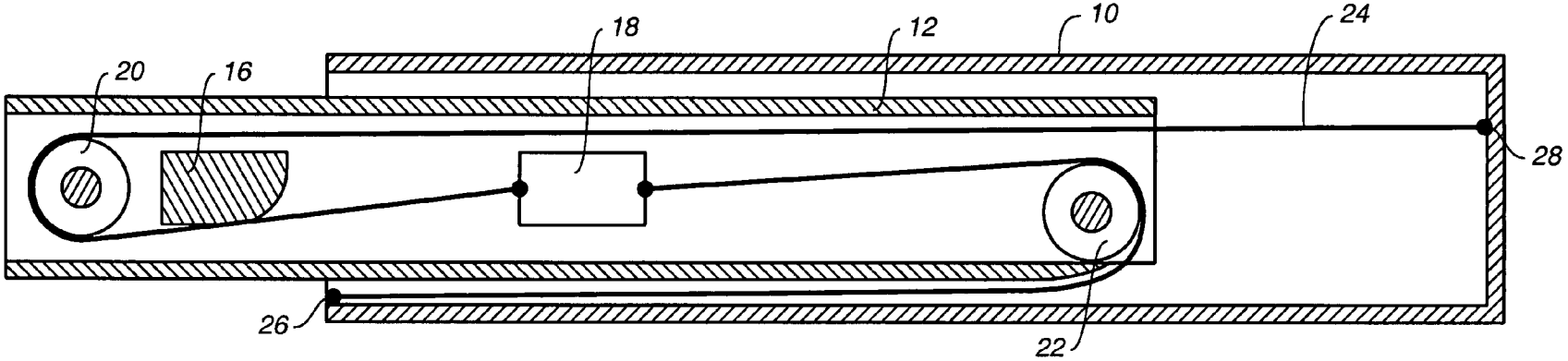

FIGS. 7A and 7B show a cross-sectional view of the telescoped sleeves taken from above with the top faces of both sleeves removed. An operating band 24 (FIGS. 7A, 7B) is connected to movable jaw 18 and is attached to outer sleeve 10 at two fixed points; a front fixed point 26 and a rear fixed point 28. From front fixed point 26 band 24 passes down one side of the space between inner sleeve 12 and outer sleeve 10 to a rear rotating spindle 22 located at the rear end of inner sleeve 12. Spindle 22 is fixedly attached to the rear end of inner sleeve 12. The band is routed around spindle 22 (FIGS. 7A, 7B) and then up inside inner sleeve 12 until it attaches to the upper portion of movable jaw 18. From there the band continues forward along the inside of inner sleeve 12 to a front rotating spindle 20 located directly behind fixed jaw 16. Spindle 20 is fixedly attached to the front end of inner sleeve 12. It passes around this spindle and returns back down inside inner sleeve 12 until it reaches the end of the sleeve, where it emerges from inner sleeve 12 and attaches to outer sleeve 10 at a rear fixed point 28.

Figure 2B:
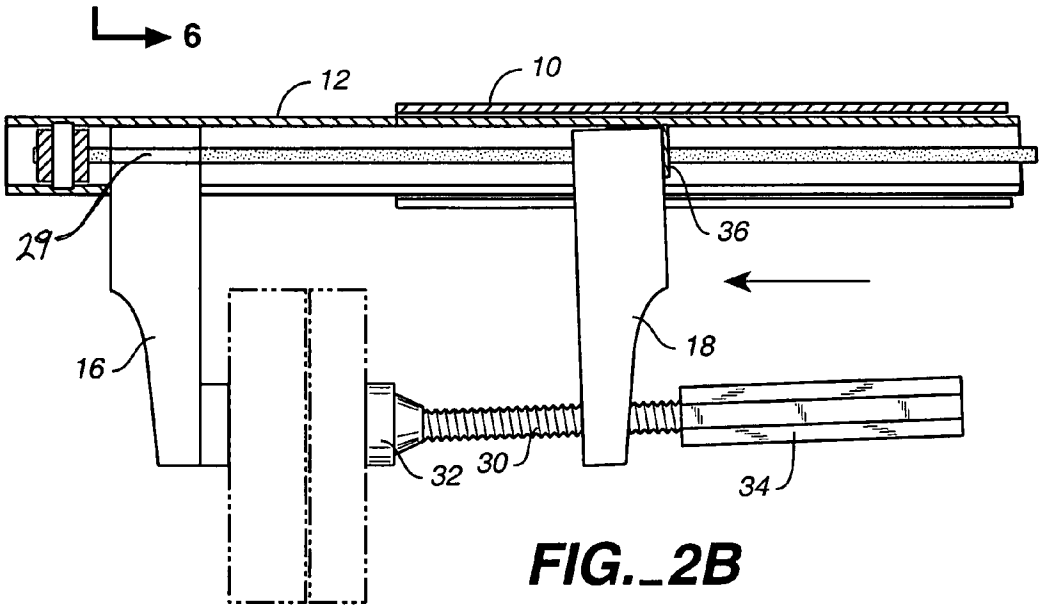
FIG. 2B shows a similar vertical section, but with the two jaws under pressure against the work piece.
Figures 3A, 3B:
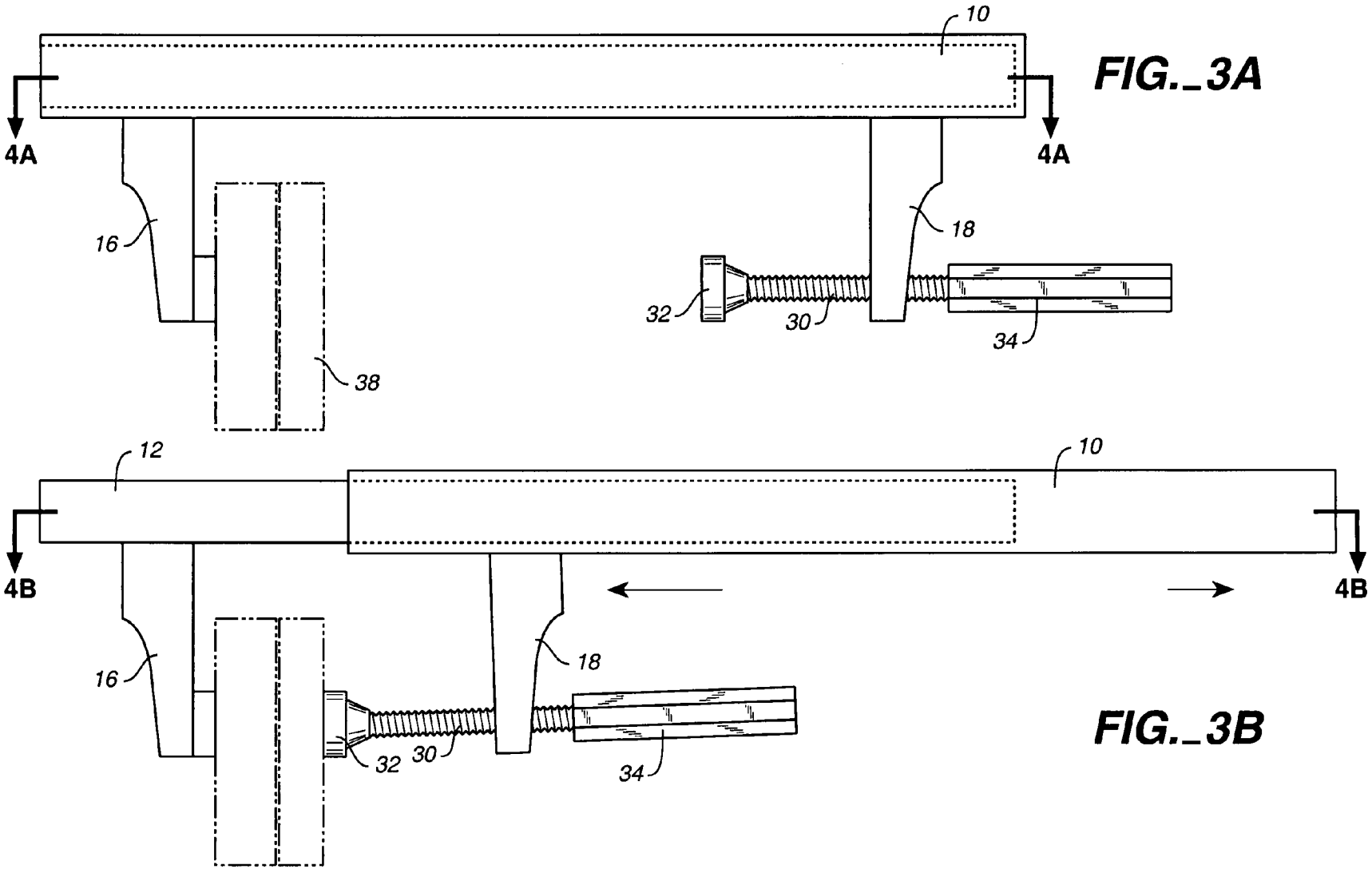
FIGS. 3A and 3B show a side view of the clamp's exterior in open and closed positions.
Figure 4A:
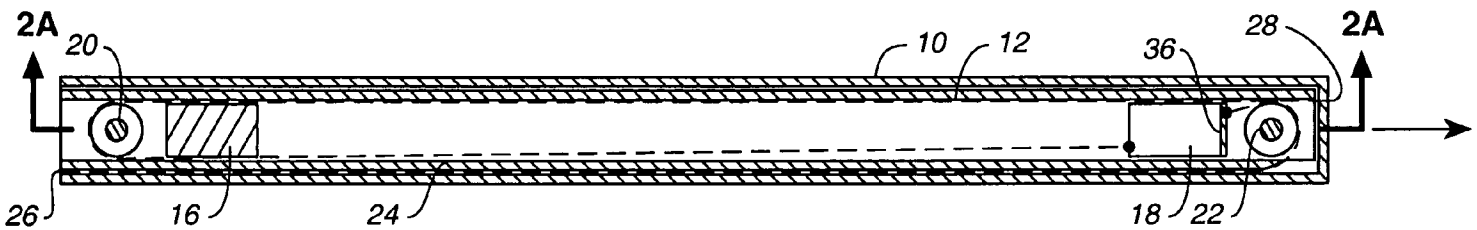
FIGS. 4A and 4B show a horizontal section through the clamp body, with the clamp in open and closed positions, respectively.
Figure 4B:
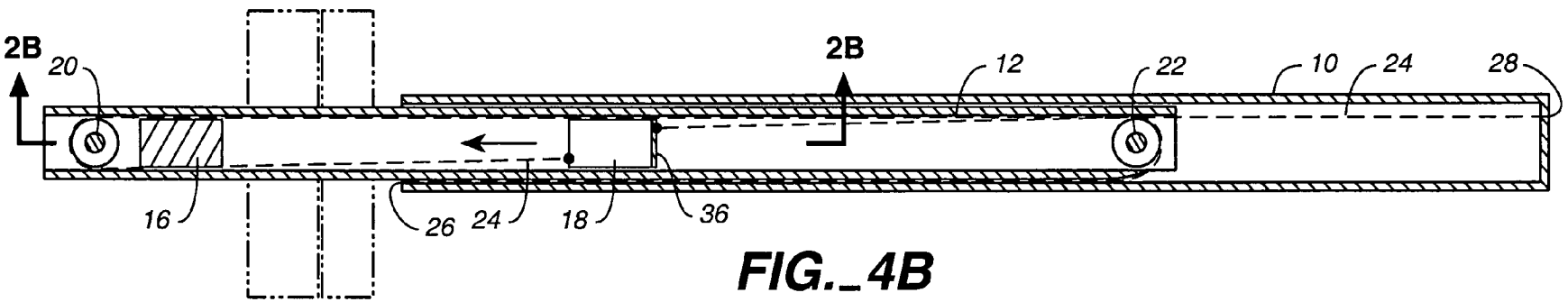
Figure 5:
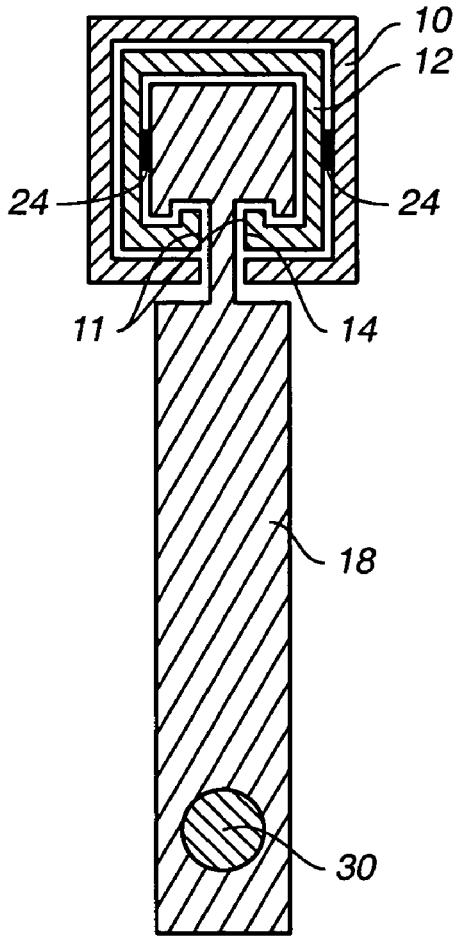
FIG. 5 shows a cross section of the clamp body, taken through section line 5—5 in FIG. 2A.
Figure 6:
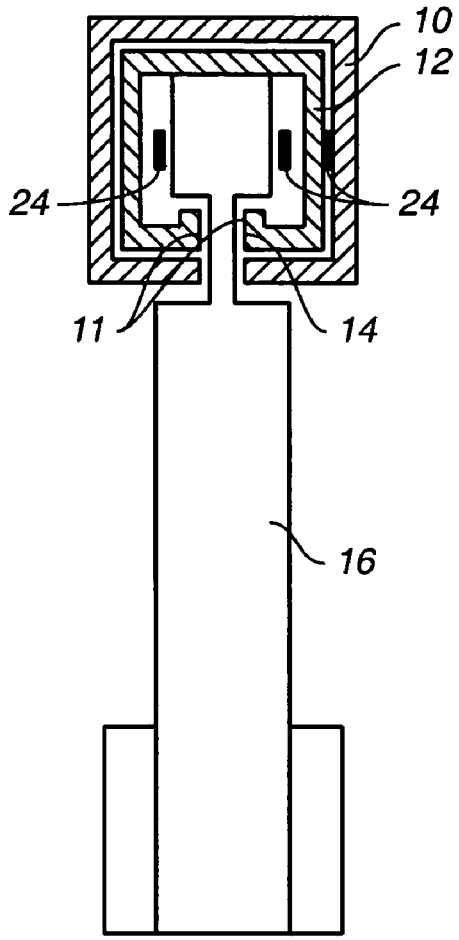
FIG. 6 shows a cross section of the clamp body taken through section line 6—6 in FIG. 2A.

The upper portion of fixed jaw 16 (FIG. 2B) conforms to the cavity of the inner sleeve 12 with the exception of a horizontal groove 29 which allows operating band 24 to pass by it on its way to and from front spindle 20 (FIG. 2B).

The upper portion of movable jaw 18 is similar, except that groove 29 is only present on one side of the jaw. A hardened metal plate 36 (FIGS. 2A, 2B) is fastened to the back of the upper portion of the jaw.

The lower portions of the two jaws are of sufficient stiffness to withstand the working pressure of the clamp and are provided with a flat face or pad 32 which contacts the work being clamped. Movable jaw 18 (FIGS. 1A, 1B) has a drilled and tapped hole at its bottom end through which a threaded shaft 30 is passed. A swivel pad 32 is mounted on the front end of this shaft, and a handle 34 is provided for tightening on the other end.

Both jaws of the clamp and inner sleeve 12 are made of steel or other material suitably stiff to withstand the working pressure of the clamp. Outer sleeve 10 may be made of a heavy plastic or equivalent, since it does not have to withstand clamping pressure. Handle 34 is made to fit comfortably in the hand, and preferably is made of wood. Hardened plate 36 is made of material slightly harder than inner sleeve 12. Operating band 24 is made of a non-stretch material such as a woven metal alloy or zero-stretch plastic, which is flexible enough to pass easily around spindles 20 and 22. The thickness of various components relates directly to the overall capacity of the clamp. Sidewall thickness of approximately 0.1875 in. and a cross section of approximately 1 by 1.25 in. should be sufficient for a clamp with an 18" capacity. The longer the two sleeves, the heavier the individual components need to be.

OPERATION OF THE PREFERRED EMBODIMENT

The operation of the clamp is as follows. The body of the clamp (FIG. 1A) is positioned above the pieces to be clamped. The clamp is lowered onto work 38 (here shown as two blocks of wood) and then drawn back until fixed jaw 16 touches the left face of work 38. With fixed jaw 16 and inner sleeve 12 to which it is attached thus immobilized, the operator continues to pull the clamp backward, holding it by outer sleeve 10. As the operator pulls back outer sleeve 10 as indicated in FIG. 7A, sleeve 10 draws back rear fixed point 28 of operating band 24. As this happens band 24 is drawn around and rotates front rotating spindle 20 which is mounted on a vertical axis at the front of inner sleeve 12. This motion of band 24 (FIG. 7B) causes movable jaw 18 to be drawn forward along inner sleeve 12 until pad 32 on threaded shaft 30 contacts the right side of work 38 being clamped (FIG. 2B).

As outer sleeve 10 is pulled more forcibly after jaw 18 contacts the right side of work 38, the upper portion of movable jaw 18 continues to move forward slightly inside inner sleeve 12, while the lower portion of jaw 18, which extends down through slot 14 in both inner and outer sleeves 12 and 10 squeezes against the work more forcibly. This in turn causes movable jaw 18 to tilt slightly so that its upper portion (FIG. 2B) is farther to the left than its lower portion.

The jaws thus squeeze and clamp the work. The operator then rotates threaded shaft 30 by turning handle 34 to exert additional pressure on the work. This causes movable jaw 18 to tilt even further inside inner sleeve 12, so that the top edge of plate 36, which is attached to the back of the jaw, is pressed up against the top of the cavity of inner sleeve 12 (FIG. 2B). This causes movable jaw 18 to jam and thereby fix its position in relation to the body of the clamp.

The operator rotates handle 34 on threaded shaft 30, to cause pad 32 to squeeze work 38 with as much pressure as is required.

Thus the operator is able to use the device to clamp work 38 tightly, with full vise force, by using only one hand. During this procedure the operator's other hand is free to monitor the relative position of the individual pieces being clamped, and make any last minute adjustments that may be necessary.

Removing the clamp is the reverse of the installation process. Holding outer sleeve 10 with one hand, the operator rotates handle 34, causing threaded shaft 30 to back off until pad 32 no longer contacts work 38. At this point movable jaw 18 is no longer under pressure. Plate 32 then disengages, and the jaw drops back to a vertical position relative to the clamp body.

The operator then moves outer sleeve 10 forward (FIG. 7A). As this happens, front fixed point 26 of operating band 24 also moves forward, causing operating band 24 to be drawn around rear rotating spindle 22. This reverses the direction of motion of operating band 24, which then draws movable jaw 18 back along inner sleeve 12, away from the front of the clamp. The clamp may then be lifted clear of the work, and is ready for use again.

ADVANTAGES

From the above description, a number of advantages of my automatically closing clamp become evident (a) An operator faced with a complex assembly may direct all of his or her attention to the pieces to be assembled, without having to break concentration to get the clamps set up.

(b) Once adhesive is applied to the work, the operator is able to attach the clamp with one simple single-hand motion—the other hand is free at all times to monitor the relative position of the parts being clamped.

(c) The amount of pressure available to the operator is restricted only by the failure point or limit of the clamp components.

(d) The relative position of the two jaws can be changed quickly and easily, so that the clamp can be installed and removed in an efficient manner

CONCLUSION, RAMIFICATIONS, AND SCOPE

Accordingly, the reader will see that the automatically closing clamp can be used to hold together two or more pieces of material for gluing, test fitting, or alignment purposes, and may be quickly and easily removed once the operation is completed. In addition, the operator can bring the two jaws of the clamp together using only one hand; the other hand remains free to monitor the relative positions of the pieces being assembled. If final readjustments are required, it is a simple matter to back off the movable jaw just far enough to allow these adjustments to be made; again, only one hand is required for this operation so that the operator need not let go of the pieces being clamped together. Since this clamp is simpler to operate, the operator is able to concentrate more directly on the project at hand, and the clamp itself is less likely to be the source of difficulty or damage to the work pieces. Furthermore, this automatically closing clamp has additional advantages in that it provides a quick and efficient means of clamping two objects together it allows the operator to concentrate on the pieces to be clamped, rather than expending time and effort attending to the clamps themselves it allows the operator to keep one hand on the work pieces at all times, so that position and alignment can be continuously monitored until the final tightening it provides a means of clamping which is simple and quick to use, and therefore less likely to get in the way or cause damage to objects being clamped together.

it provides a clamp which can be easily and quickly adjusted for realignment of the work pieces, and can be easily removed when the clamping process is completed.

Although the description above contains many specificities, these should not be construed as limiting the scope of the invention but as merely providing illustrations of some of the presently preferred embodiments of this invention. Many variations are possible. For example, the cross section of the two sleeves need not be rectangular. They can be circular, hexagonal, or some other shape. The operating band can be flat or round in cross section, and the spindles can also be pulleys. Additionally, the movable jaw can have a sharpened edge mounted on its leading edge so that the device can function as a shearing device.

Thus the scope of the invention should be determined by the appended claims and their legal equivalents, rather than by the examples given.

I claim:

1. A clamp that can be operated with one hand, comprising:

an elongated clamping body, a first, fixed clamping jaw adjacent one end of said body, a second, movable clamping jaw that is captivated within and movable along said elongated body to and from said first, fixed clamping jaw, moving means for causing, in response to a pull exerted on said elongated body in a predetermined direction, said second, movable clamping jaw to move along said elongated body from a location relatively distant from said second, movable clamping jaw toward said first, fixed clamping jaw, thereby to clamp onto and squeeze any work piece between said first, fixed clamping jaw and said second, movable clamping jaw, whereby said clamp can be used to clamp onto and squeeze said work piece by using only one hand.

2. The clamp of claim 1 wherein said moving means comprises a flexible band in said elongated body.

3. The clamp of claim 1, further including a turn screw-adjustable jaw piece attached to one of first, fixed clamping jaw and said second, movable clamping jaw for squeezing said work piece with greater force than is applied in response to said pull exerted on said elongated body in said predetermined direction.

4. The clamp of claim 1 wherein said elongated clamping body comprises a pair of telescopingly sliding tubes.

5. The clamp of claim 1 wherein said elongated clamping body comprises a pair of telescopingly sliding tubes, said tubes having a non-circular cross-section.

6. The clamp of claim 1 wherein said elongated clamping body comprises a pair of telescopingly sliding tubes, said tubes having a rectangular cross-section.

7. The clamp of claim 1 wherein said elongated clamping body comprises a pair of telescopingly sliding tubes, one of said tubes being an inner tube and the other being an outer tube, said first, fixed clamping jaw being fixedly attached to one end of said inner sleeve and said second, movable clamping jaw being free to slide along said inner jaw.

8. The clamp of claim 1 wherein said moving means comprises a flexible band in said elongated body, said elongated clamping body comprises a pair of telescopingly sliding tubes, one of said tubes being an inner tube and the other being an outer tube, said first, fixed clamping jaw being fixedly attached to one end of said inner sleeve and said second, movable clamping jaw being free to slide along said inner jaw and being attached to said flexible band.

9. The clamp of claim 1 wherein said moving means comprises a flexible band in said elongated body, said elongated clamping body comprises a pair of telescopingly sliding tubes, one of said tubes being an inner tube and the other being an outer tube, said first, fixed clamping jaw being fixedly attached to one end of said inner sleeve, said second, movable clamping jaw being free to slide along said inner tube, a flexible connecting band having two ends, with one end being attached to one end of said outer tube and the other end being attached to the other end of said outer tube, said second, movable clamping jaw being attached to a part of said flexible band between the ends thereof.

10. The clamp of claim 1 wherein said moving means comprises a flexible band in said elongated body, said elongated body comprises a pair of telescopingly sliding tubes, one of said tubes being an inner tube and the other being an outer tube, said first, fixed clamping jaw being fixedly attached to one end of said inner sleeve, said second, movable clamping jaw being free to slide along said inner tube, a flexible connecting band having two ends, with one end being attached to one end of said outer tube and the other end being attached to the other end of said outer tube, said second, movable clamping jaw being attached to a part of said flexible band between the ends thereof, and further including a pair of spindles attached at opposite ends of said inner tube, said flexible connecting band extending around each of said spindles.

11. The clamp of claim 1 wherein said elongated clamping body comprises a pair of telescopingly sliding tubes, one of said tubes being an inner tube and the other being an outer tube, said first, fixed clamping jaw being fixedly attached to one end of said inner tube and said second, movable clamping jaw being free to slide along said inner jaw, each of said tubes having a slot therein, said slots being aligned, said first, fixed clamping jaw and said second, movable clamping jaw each having upper and lower portions extending through said slots so that said upper portion of each jaw is inside said tubes and said lower portion of each jaw is outside said tubes.

12. A clamp than can be operated with one hand, comprising:

a pair of telescopingly mated sleeves or tubes, one of said tubes being an inner tube and the other being an outer tube, each of said sleeves having opposite ends, a first, fixed clamping jaw attached to one end of said inner tube, a flexible connecting band having two ends, with one end being attached to one end of said outer tube and the other end being attached to the other end of said outer tube, a second, movable clamping jaw attached to said connecting band and being free to move along the length of said inner tube, said tubes, said first and second clamping jaws, and said connecting band being arranged so that when said first, fixed clamping jaw is placed against one side of a work piece and said outer sleeve is pulled away from said work piece, said second, movable clamping jaw will move toward said another side of said work piece and said first, fixed clamping jaw.

13. The clamp of claim 12, further including a turn screw-adjustable jaw piece attached to said second, movable clamping jaw for squeezing said work piece with greater force than is applied in response to said pull exerted on said elongated body in said predetermined direction.

14. The clamp of claim 13 wherein said pair of telescopingly mated sleeves or tubes has a rectangular cross section.

15. The clamp of claim 12, further including a pair of spindles attached at opposite ends of said inner tube, said flexible connecting band extending around each of said spindles.

16. The clamp of claim 12 wherein each of said tubes has a slot therein, said slots being aligned, said first, fixed clamping jaw and said second, movable clamping jaw each having upper and lower portions extending through said slots so that said upper portion of each jaw is inside said tubes and said lower portion of each jaw is outside said tubes.

17. A clamp that can be operated with one hand, comprising:

a pair of telescopingly mated sleeves or tubes, one of said tubes being an inner tube and the other being an outer tube, each of said tubes having opposite ends, a first, fixed clamping jaw attached adjacent one end of said inner tube, a flexible connecting band having two ends, with one end being attached to one end of said outer tube and the other end being attached to the other end of said outer tube, a second, movable clamping jaw attached to said connecting band between the ends thereof and being free to move along the length of said inner tube, a pair of spindles attached at opposite ends of said inner tube, said flexible connecting band extending around each of said spindles, said tubes, said first and second clamping jaws, said spindles, and said connecting band being arranged so that when said first, fixed clamping jaw is placed against one side of a work piece and said outer sleeve is pulled away from said work piece, said second, movable clamping jaw will move toward said another side of said work piece and said first, fixed clamping jaw.

18. The clamp of claim 17 wherein each of said tubes has a slot therein, said slots being aligned, said first, fixed clamping jaw and said second, movable clamping jaw each having upper and lower portions extending through said slots so that said upper portion of each jaw is inside said tubes and said lower portion of each jaw is outside said tubes.

19. The clamp of claim 17, further including a turn screw-adjustable jaw piece attached to second, movable clamping jaw for squeezing said work piece with greater force than is applied in response to said pull exerted on said elongated body in said predetermined direction.

20. The clamp of claim 17 wherein said tubes each has a rectangular cross section.

* * * * *